US006071078A

United States Patent [19]

Schlegel et al.

[11] Patent Number: 6,071,078

[45] Date of Patent: Jun. 6, 2000

[54] SNAP FIT RING BRACKET-SHROUD MOUNTING ASSEMBLY

[75] Inventors: Jennifer J. Schlegel, Kettering; Lisa E. Lindemann, Centerville; Steven J. Barnes, Kettering; Michael W. Boles, Springboro; John R. Savage, Kettering, all of Ohio

[73] Assignee: ITT Manufacturing Enterprises Inc., Wilmington, Del.

[21] Appl. No.: 08/879,903

[22] Filed: Jun. 19, 1997

[51] Int. Cl.[7] ..... F04D 29/64

[52] U.S. Cl. ..... 416/247 R; 416/189; 416/192; 415/121.2; 415/213.1

[58] Field of Search ..... 416/189, 247 R, 416/191, 192, 244 R, 169 A, 93; 415/121.2, 214.1, 213.1; 403/348, 349, 315, 316

[56] References Cited

U.S. PATENT DOCUMENTS 4,834,615 5/1989 Mauch et al. ..... 415/213.1
5,080,501 1/1992 Siebert et al. ..... 384/537
5,498,130 3/1996 Wakley et al. ..... 415/213.1

FOREIGN PATENT DOCUMENTS 54-0136404 10/1979 Japan ..... 415/214.1

*Primary Examiner*—F. Daniel Lopez
*Assistant Examiner*—Richard Woo
*Attorney, Agent, or Firm*—J. Gordon Lewis

[57] ABSTRACT

A ring bracket-shroud mounting assembly for an car engine cooling system includes a bracket for enclosing and supporting fan blades and motor, and a shroud with a mounting seat for supporting the bracket. The bracket has at least one active lock coupler, and a shroud has at least one passive lock coupler. Each active lock coupler includes an overhanging means and each passive lock coupler includes a catch. The overhanging apparatus and catch are adapted to matingly engage and retain the ring bracket to the shroud when the overhanging apparatus and catch are placed adjacent to each other and the ring bracket is rotated relative to the shroud to a locking position to have the overhanging apparatus combined with the catch.

11 Claims, 4 Drawing Sheets

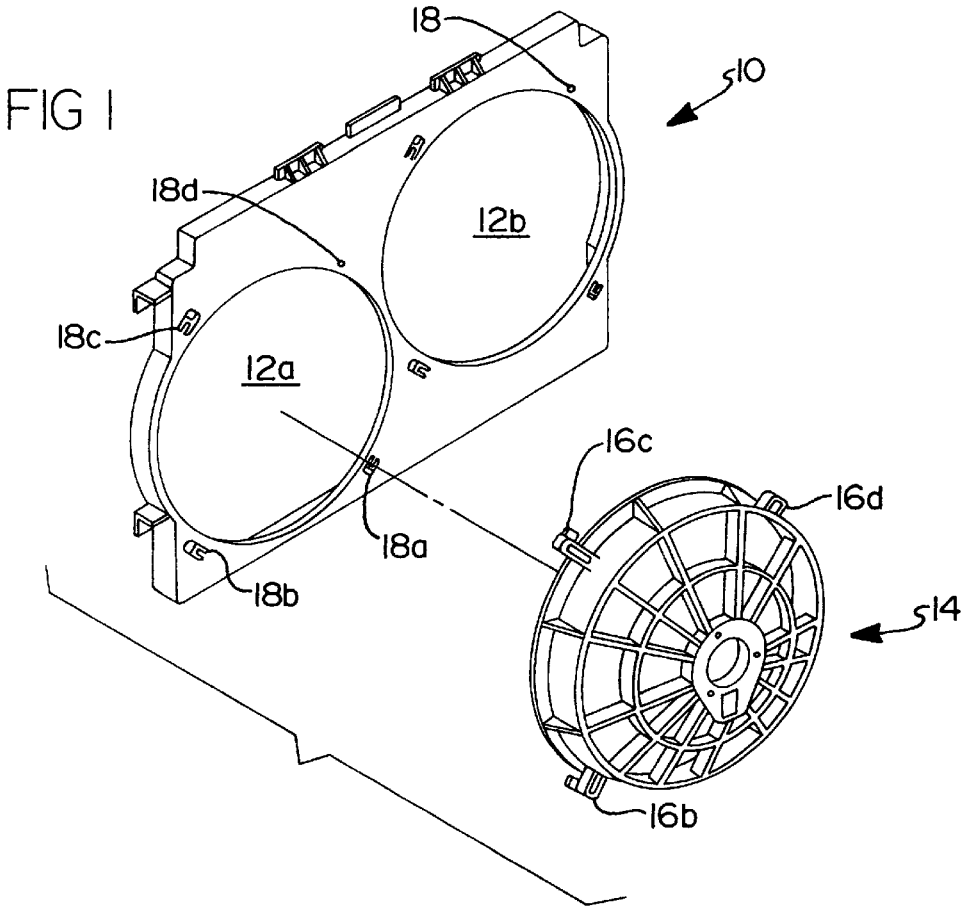
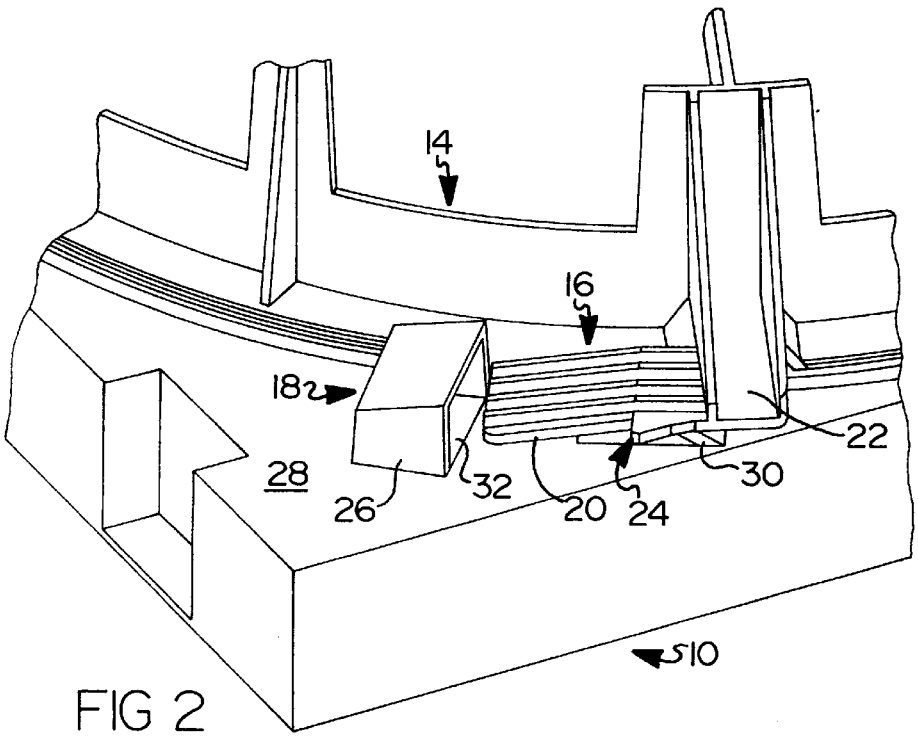
FIG 2

FIG 3
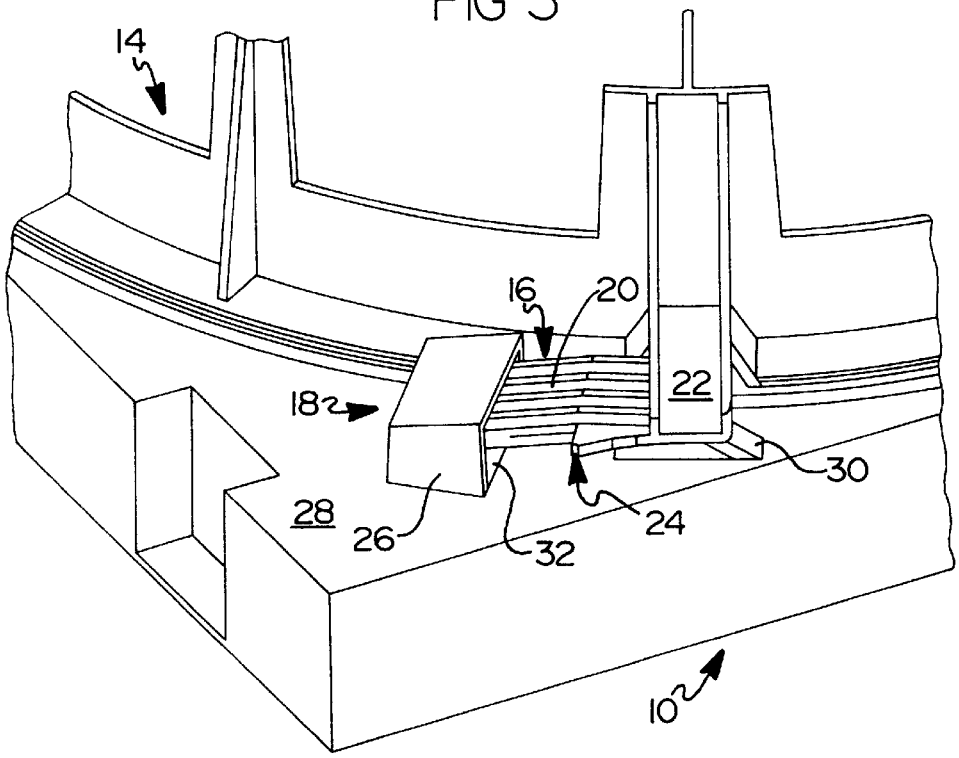
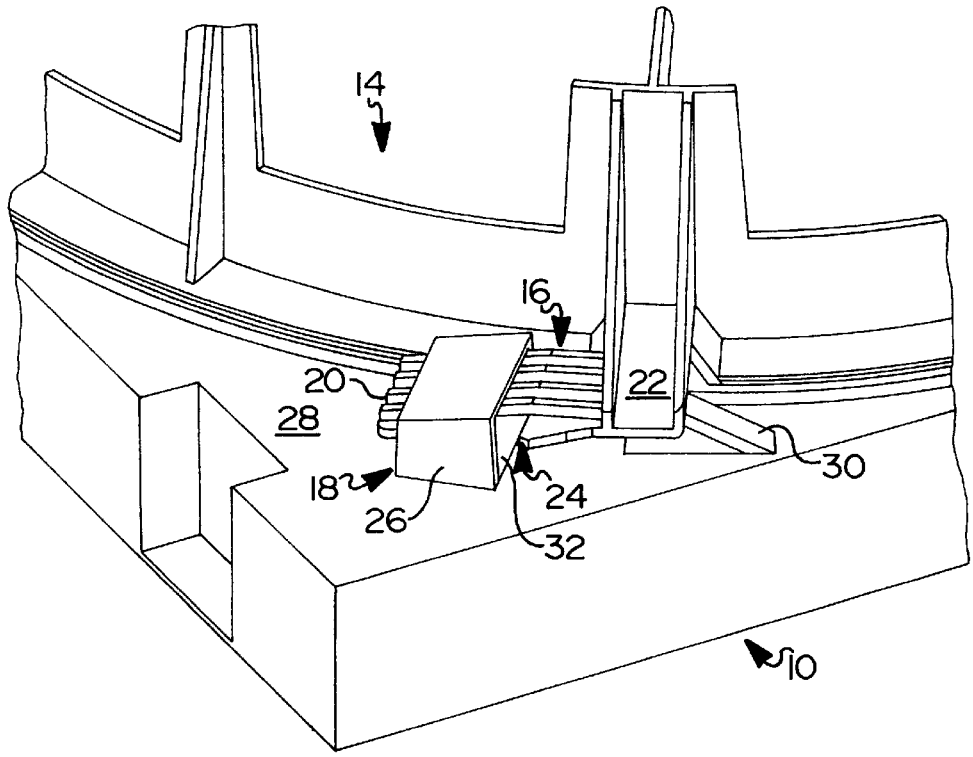
FIG 4

FIG 5
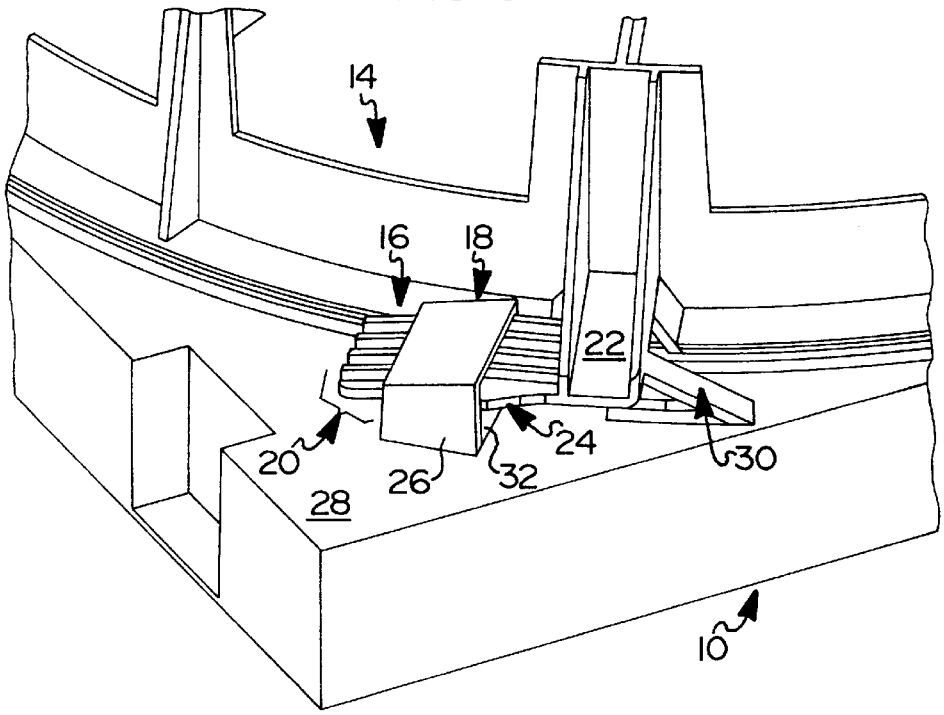
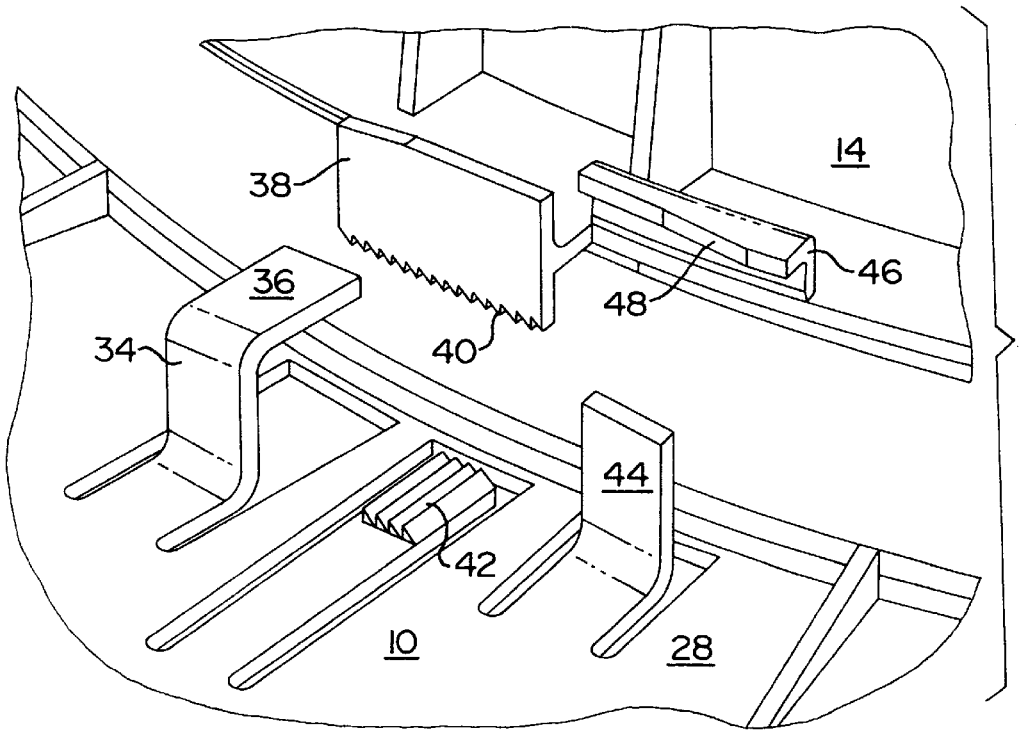
FIG 6

FIG 7
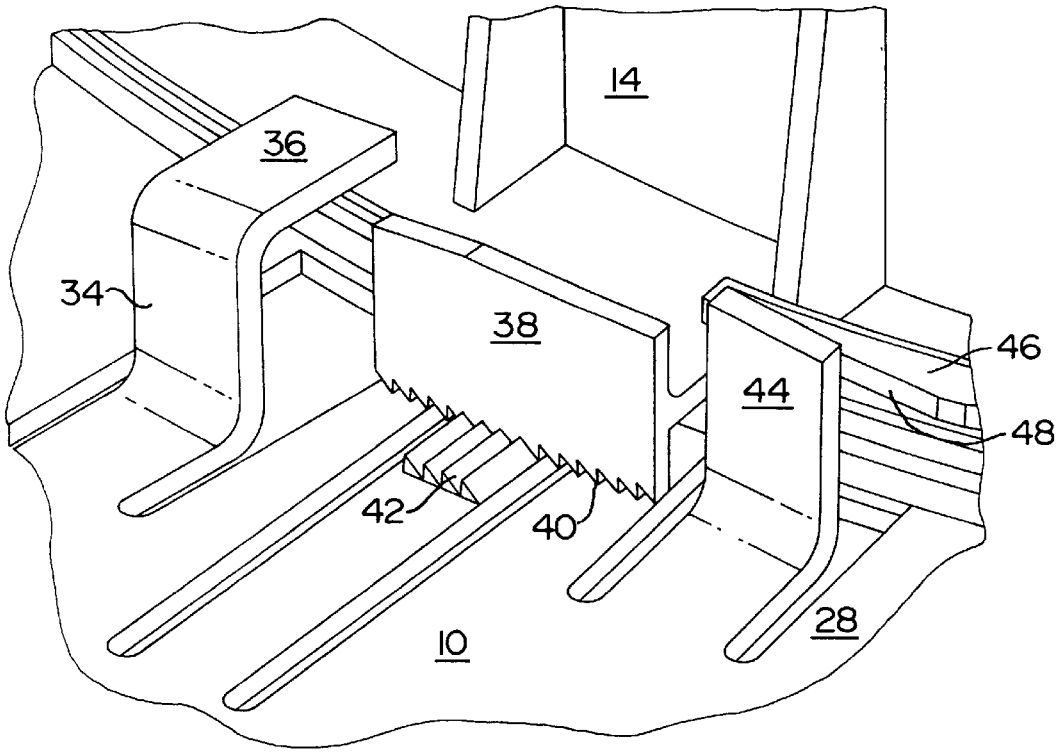
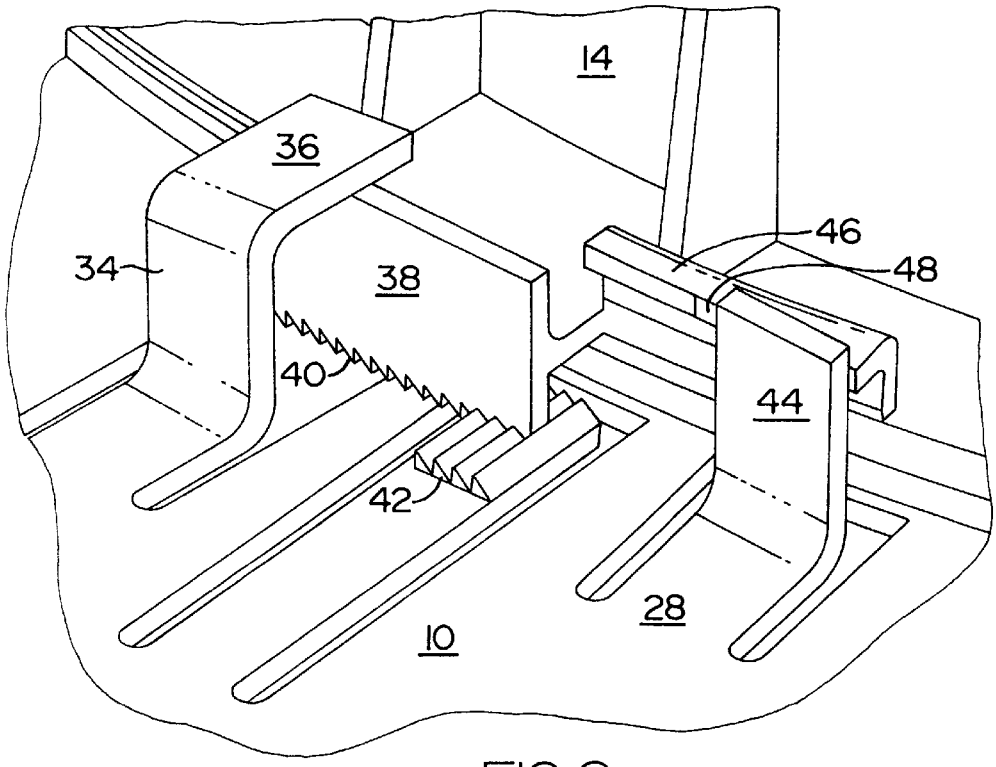
FIG 8

SNAP FIT RING BRACKET-SHROUD MOUNTING ASSEMBLY

BACKGROUND OF THE INVENTION

1. Field of the Invention

The present invention relates to car engine cooling system. More specifically, the invention deals with a ring bracket-shroud assembly for supporting a cooling fan. Even more precisely, the present invention concerns a novel snap fit, fastenerless bracket-shroud mounting structure.

2. Description of Related Art

Currently in cars, cooling systems are used to lower the high temperature generated during engine operation. If the engine is not cooled, valves will burn and warp, lubricating oil will break down, pistons and bearing will overheat, and pistons will seize in the cylinders. The basic automobile cooling system components are a radiator with a plurality of tubes, a coolant pump, a system of passages and water jackets in the cylinder head and cylinder block through which the coolant circulates, and a fan. Specifically, the fan draws air over the outside surfaces of the radiator tubes and cools the coolant as it travels through them and thus rapidly dissipates the heat carried by the coolant. In addition to removing heat from the radiator, this flow of air also provides some direct air cooling of the engine.

Typically, the fan is mounted in a ring bracket which encloses and supports fan blades and its motor. In turn, the bracket is attached to a shroud. For this attachment to be done, the bracket has several pads, usually four, equally spaced around the perimeter of the bracket. Each pad typically includes a screw and washer for mounting the bracket to the shroud. It is not infrequent for some car models to have a pair of cooling fans and, respectively, a pair of ring brackets. Mounting the brackets on the shroud thus requires eight J-clips and eight screw and washer sets.

In the context of the above, a need exists in the art for means allowing for more simple, reliable and less labor consuming mounting structure for pre-assembling a fan ring bracket to a shroud.

SUMMARY OF THE INVENTION

Therefore, a principal object of the present invention consists in providing a ring bracket-shroud assembly for supporting a cooling fan which assembly would lack disadvantages of the prior art, yet keeping all their positive features.

Another object of the present invention lies in providing a bracket-shroud assembly which is technologically simpler, more reliable and less time consuming in assembling than the prior art product.

Yet another object of the present invention resides in providing a snap fit, fastenerless bracket-shroud assembly.

In its first aspect, the present invention achieves the foregoing and other objects by setting forth a ring bracket-shroud mounting assembly, comprising a ring bracket having at least one active lock coupler, and a shroud having respectively at least one passive lock coupler disposed on a shroud surface. The active lock coupler includes an overhanging means and the passive lock couplers includes a catch. The overhanging means and catch are adapted to matingly engage and retain the ring bracket to the shroud when the overhanging means and catch are placed adjacent to each other and the ring bracket is rotated relative to the shroud to a locking position to have the overhanging means combined with the catch.

The catch has a box-like structure and the overhanging means includes an active tab passing therethrough in the locking position.

The active tab is provided with a positive stop to restrict forward rotation thereof relative to the box-like structure of the catch.

The shroud is provided with an anti-rotate resilient tab to prevent the active tab from spontaneous backward rotation.

The anti-rotate resilient tab can be made integral with the shroud surface.

Alternatively, the catch can include a Z-shaped beam to axially catch the ring bracket. The Z-shaped beam is made resiliently fixed on the shroud surface and has an arm which is elevated above the shroud surface. The overhanging means can include a cantilever passing under the arm in the locking position of the assembly.

The cantilever is provided with a toothed edge, and the shroud surface is provided with a ratchet resiliently disposed on the shroud surface to engage the cantilever toothed edge when the cantilever is rotated to the locking position of the assembly.

The Z-shaped beam can be made integral with the shroud surface.

The shroud surface can be also provided with a radial centering beam, and the ring bracket is provided with a tab. The tab has a tapered front surface to radially meet the radial centering beam when the ring bracket is rotated relative to the shroud to the locking position of the assembly.

The radial centering beam can be made integral with said shroud surface.

In another aspect of the present invention, it sets forth a fan mounting assembly for a car engine air cooling system having at least one engine cooling fan. The assembly comprises at least one ring bracket for supporting cooling fan blades and motor, and a shroud. The ring bracket has a plurality of active lock couplers, and the shroud has a respective plurality of passive lock couplers disposed on a shroud surface. Each of the active lock coupler includes an overhanging means and each of the passive lock couplers includes a catch. The overhanging means and catch are adapted to matingly engage and retain the ring bracket to the shroud when the overhanging means and catch are placed adjacent to each other and the ring bracket is rotated relative to the shroud to a locking position to have the overhanging means combined with the catch.

BRIEF DESCRIPTION OF DRAWINGS

Other objects, advantages and features of the present invention will become apparent from the ensuing description taken in connection with the accompanying drawings in which:

FIG. 1 is an exploded view of a ring bracket-shroud assembly according to the present invention.

FIGS. 2–5 show progressively a mounting cooperation between a ring bracket and a shroud according to the first modification of the present invention.

FIGS. 6–8 show progressively a mounting cooperation between a ring bracket and a shroud according to the second modification of the present invention.

DESCRIPTION OF THE PREFERRED EMBODIMENTS

Referring now to FIG. 1, an exploded view is shown of a shroud 10 with two openings 12*a* and 12*b* and a ring bracket 14 used in cars for enclosing fan blades and supporting fan motors (fan blades and fan motors not shown). For simplicity, only one of two identical ring brackets is shown. The general construction of the shroud and the brackets is known to those skilled in the art, and the importance of this invention relates to the means of attaching the ring bracket 14 to the shroud 10.

The bracket 14 shown in FIG. 1 comprises four active lock couplers 16*a–d* preferably equidistantly located around the circumference of the bracket. The shroud 10 shown in FIG. 1 comprises four passive lock couplers 18*a–d* located in an identical fashion around the circumference of the openings 12*a* and 12*b*. There are two modifications of active-passive lock coupler pairs shown in FIGS. 2–5 and 6–8, respectively, and discussed below in more detail. In principle, the pairs are interchangeable so, for a given ring bracket-shroud assembly, all of them could be identical or, alternatively, one part of the pairs can represent one modification and the remaining pair(s) can represent the other modification.

As it can be seen in FIGS. 2–5, where mounting cooperation between the ring bracket and the shroud according to the first modification of the present invention is progressively shown, the active lock coupler 16 includes a active tab 20 overhanging from the ring bracket 14 and attached to a rib 22 of the bracket 14. The active tab 20 is provided with a positive stop 24 the purpose of which will be discussed below. For its part, the passive lock coupler 18 includes a catch 26 located on a surface 28 of the shroud 10. The catch 26 has a box-like configuration and is intended to receive the active tab 20. Also, there is provided an anti-rotate tab 30 on the surface 28. The anti-rotate tab 30 can be made integral with the shroud 10. It is resiliently projected from the surface 28.

In operation, the ring bracket 14 is applied to the shroud 10, thus covering the opening 12. Each active lock coupler of the couplers 16*a–d* is positioned adjacent to its associated passive lock coupler of the couplers 18*a–d*. When rotated clockwise, the ring bracket has its active couplers (exemplified by the active tab 20 in FIGS. 2–5) gradually passing into, and then through, the passive coupler (exemplified by the catch 26 in same FIGS. 2–5) matingly engaging it and thus retaining the ring bracket 14 to the shroud 10. The contour of a cavity 32 inside the catch 26, on one hand, and the shape of the active tab 20, on the other hand, are selected in such a way that a snap fit connection is attained therebetween. As can be best seen in FIG. 5, by meeting the catch 26 the positive stop 24 places a limit to this passing of the active tab 20 through the catch 26. During the rotation of the ring bracket 14 relative to the shroud 10, as soon as the rib 22 passes the anti-rotate tab 30, the latter pops up and thus prevents the ring bracket from spontaneous backward rotation. The ring bracket is thus brought into a locking position. Once the engagement of the catch and the active tab is complete, the parts assume positions shown in FIG. 5.

An alternative modification of the ring bracket-shroud assembly according to the present invention is shown in FIGS. 6–8 where mounting cooperation between the ring bracket 14 and the shroud 10 in accordance with this second variant of the invention is progressively depicted. For this modification, the catch 26 of the passive lock coupler 18 includes a Z-shaped beam 34. The beam 34 is resiliently fixed on the shroud surface 28 and can be made integral therewith. It has an arm 36 which is elevated above the shroud surface 28. The active lock coupler 16 includes, for this case, a cantilever 38 overhanging from the ring bracket 14. The cantilever is provided with a toothed edge 40. Correspondingly, there is provided a ratchet 42 resiliently disposed on the surface 28 to engage the toothed edge 40 of the cantilever 38. Also there is a radial centering beam 44 placed on the surface 28. The beam 44 is intended to cooperate with a tab 46 attached to the bracket 14. The tab 46 is made with a tapered front surface 48 intended to cooperate with the radial centering beam 44. Both the ratchet 42 and the beam 44 can be made integral with the surface 28.

In operation, the ring bracket 14 is applied to the shroud 10, thus covering the opening 12. Each active lock coupler of the couplers 16*a–d* is positioned adjacent to its associated passive lock coupler of the couplers 18*a–d*. When rotated clockwise, the ring bracket 14 has its active couplers (exemplified by the cantilever 38 in FIGS. 6–8) gradually passing through the passive coupler (exemplified by the Z-shaped beam 34 (under whose arm 36 the cantilever 38 passes) and ratchet 42 in same FIGS. 6–8) matingly engaging the passive coupler and thus retaining the ring bracket 14 to the shroud 10. The tapered front surface 48 provides a snap fit connection between the ring bracket 14 and the shroud 10. Radial and axial displacement of the bracket 14 relative to the shroud 10 are prevented by the radial centering beam 44 and the Z-shaped beam 34, respectively. Once the engagement of the Z-shaped beam 34, the ratchet 42 and the radial centering beam 44, on one hand, and the cantilever 38 and the tab 46, on the other hand, is complete, the assembly is brought into a locking position, and the parts assume positions shown in FIG. 8.

Beside eliminating the necessity of having eight screw/washers pairs and eight J-clips and labor expenses connected with using the same, the present invention has an additional advantage. The rotating action discussed in the above accomplishes three functions simultaneously: it centers the ring bracket in the shroud; it clamps the ring bracket axially; also the anti-rotate tab/ratchet catch prohibits the ring bracket from backing out. A positive retention in all three axes is maintained.

As apparent from the foregoing specification, the present invention is susceptible of being embodied with various alterations and modifications which may differ particularly from that described in the preceding description. It should be understood that all such modifications as reasonably and properly come within the scope of authors' contribution to the art are intended to be embodied within the scope of the patent warranted hereon.

What is claimed is:

1. A ring bracket-shroud mounting assembly, comprising: a ring bracket having at least one active lock coupler, and a shroud having respectively at least one passive lock coupler disposed on a shroud surface, wherein said active lock coupler includes an overhanging means and said passive lock couplers includes a catch, wherein said overhanging means and catch are adapted to matingly engage and retain said ring bracket to said shroud when said overhanging means and catch are placed adjacent to each other and said ring bracket is rotated relative to said shroud to a locking position to have said overhanging means combined with said catch, and wherein said catch includes a Z-shaped beam to axially catch said ring bracket, said Z-shaped beam being made resiliently fixed on said shroud surface and having an arm, said arm being elevated above said shroud surface, and said overhanging means includes a cantilever passing under said arm in said locking position.

2. The ring bracket-shroud mounting assembly as claimed in claim 1, wherein said cantilever is provided with a toothed edge, and said shroud surface is provided with a ratchet resiliently disposed thereon to engage said cantilever toothed edge when said cantilever is rotated to said locking position.

3. The ring bracket-shroud mounting assembly as claimed in claim 1, wherein said Z-shaped beam is made integral with said shroud surface.

4. The ring bracket-shroud mounting assembly as claimed in claim 1, wherein said shroud surface is provided with a radial centering beam, and said ring bracket is provided with a tab, said tab having a tapered front surface to radially meet said radial centering beam when said ring bracket is rotated relative to said shroud to said locking position.

5. The ring bracket-shroud mounting assembly as claimed in claim 4, wherein said radial centering beam is made integral with said shroud surface.

6. A fan mounting assembly for a car engine air cooling system having at least one engine cooling fan, said assembly comprising: at least one ring bracket for supporting cooling fan blades and motor, and a shroud, said at least one ring bracket having a plurality of active lock couplers, said shroud having a respective plurality of passive lock couplers disposed on a shroud surface, each active lock coupler of said plurality of active lock couplers including an overhanging means and each passive lock coupler of said respective plurality of passive lock couplers including a catch, wherein said overhanging means and said catch are adapted to matingly engage and retain said ring bracket to said shroud when said overhanging means and catch of said pluralities are placed adjacent to each other and said ring bracket is rotated relative to said shroud to a locking position to have said overhanging means combined with said catch, and wherein said catch includes a Z-shaped beam to axially catch said ring bracket, said Z-shaped beam being made resiliently fixed on said shroud surface and having an arm, said arm being elevated above said shroud surface, and said overhanging means includes a cantilever passing under said arm in said locking position.

7. The fan mounting assembly as claimed in claim 6, wherein said cantilever is provided with a toothed edge, and said shroud surface is provided with a plurality of ratchets, each ratchet of said plurality of ratchets being resiliently disposed on said shroud surface to engage said toothed edge of a respective cantilever when said cantilever is rotated to said locking position.

8. The fan mounting assembly as claimed in claim 6, wherein said Z-shaped beam is made integral with said shroud surface.

9. The fan mounting assembly as claimed in claim 6, wherein said shroud surface is provided with a plurality of radial centering beam, and said ring bracket is provided with a respective plurality of tabs, each of said tabs having a tapered front surface to radially meet said radial centering beams when said ring bracket is rotated relative to said shroud to said locking position.

10. The fan mounting assembly as claimed in claim 9, wherein said plurality of radial centering beams is made integral with said shroud surface.

11. A fan mounting assembly for a car engine air cooling system having at least one engine cooling fan, said assembly comprising: at least one ring bracket for supporting cooling fan blades and motor, and a shroud, said at least one ring bracket having a first group and a second group of active lock couplers, said shroud having a first group and a second group of passive lock couplers, respectively disposed on a shroud surface, each active lock coupler of said first and second groups of active lock couplers including a first and a second overhanging means, respectively, and each passive lock coupler of said respective first and second groups of passive lock couplers including a first and a second catch, respectively, wherein said first catch has a box-like structure and said first overhanging means includes an active tab passing therethrough in said locking position, whereas said second catch includes a Z-shaped beam to axially catch said ring bracket, said Z-shaped beam being made resiliently fixed on said shroud surface and having an arm, said arm being elevated above said shroud surface, and said second overhanging means includes a cantilever passing under said arm in said locking position, wherein said first and second overhanging means and said first and second catch are adapted to respectively and matingly engage each other and thus retain said ring bracket to said shroud when said overhanging means and catches of said groups are placed adjacent to each other and said ring bracket is rotated relative to said shroud to a locking position to have said overhanging means correspondingly combined with said catches.

* * * * *